US006621420B1

(12) United States Patent
Poursartip

(10) Patent No.: US 6,621,420 B1
(45) Date of Patent: Sep. 16, 2003

(54) DEVICE AND METHOD FOR INTEGRATED WIRELESS TRANSIT AND EMERGENCY VEHICLE MANAGEMENT

(76) Inventor: Siavash Poursartip, 385 Pimlico Dr., Walnut Creek, CA (US) 94596

( * ) Notice: Subject to any disclaimer, the term of this patent is extended or adjusted under 35 U.S.C. 154(b) by 0 days.

(21) Appl. No.: 09/997,129

(22) Filed: Nov. 29, 2001

(51) Int. Cl.[7] ..... G08G 1/095
(52) U.S. Cl. ..... 340/907; 340/906; 701/117
(58) Field of Search ..... 340/907, 906, 340/908, 436, 909, 910, 911, 924, 901, 902, 991, 992, 993; 701/201, 213, 202, 207, 208, 117

(56) References Cited

U.S. PATENT DOCUMENTS 5,172,113 A * 12/1992 Hamer ..... 340/906
5,602,739 A * 2/1997 Haagenstad et al. ..... 340/906
5,926,113 A * 7/1999 Jones et al. ..... 340/906

* cited by examiner

*Primary Examiner*—Anh La
(74) *Attorney, Agent, or Firm*—Charles L. Thoeming

(57) ABSTRACT

A vehicle detection apparatus using existing traffic preemption technologies to include automatic vehicle location, remote traffic preemption, and central decision support system for transit, congestion and emergency vehicle control. The apparatus includes emitters mounted on emergency or transit vehicles to activate and preempt existing intersection control systems, automatic vehicle location protocol, real time mapping of intersections within the system, and interconnecting communications means for transferring the system output data to the respective control or data receiving center. The preferred embodiment of the present invention uses a wireless modem with embedded software protocol connected to the preemption card installed at a typical traffic intersection controller cabinet. As vehicles approach the intersection, the wireless modem reports the location and preemption information to the control center. The information is processed at the control center and responsive traffic flow control and detection signals are transmitted to the intersection control system(s) using wireless communications devices.

10 Claims, 11 Drawing Sheets

| Address | Log # | Date | Start Time | End Time | Duration | Class | ID | Chan | Priority | G. Time | Final G. | Intensity | Present |
|---|---|---|---|---|---|---|---|---|---|---|---|---|---|
| 166.129.148.152 | 1 | 4/16/1996 | 05:35:27 | 05:35:27 | 0 | 3 | 20 | A | Low | 0 | -- | 806 | No |
| 166.129.148.150 | 1 | 5/11/1996 | 00:15:17 | 00:15:17 | 0 | 3 | 20 | A | Low | 0 | -- | 804 | No |
| 166.129.148.150 | 1 | 5/11/1996 | 00:16:34 | 00:16:34 | 0 | 3 | 20 | B | Low | 0 | -- | 478 | No |
| 166.129.148.152 | 1 | 4/16/1996 | 05:37:13 | 05:37:13 | 0 | 3 | 20 | B | Low | 0 | -- | 443 | No |
| 166.129.148.154 | 1 | 7/5/1996 | 02:28:21 | 02:28:21 | 0 | 3 | 20 | A | Low | 0 | -- | 691 | No |
| 166.129.148.152 | 1 | 4/16/1996 | 05:41:16 | 05:41:16 | 0 | 3 | 20 | A | Low | 0 | -- | 311 | No |
| 166.129.148.152 | 1 | 4/16/1996 | 05:41:47 | 05:41:47 | 0 | 3 | 20 | A | Low | 0 | -- | 522 | No |
| 166.129.148.150 | 1 | 5/11/1996 | 00:21:58 | 00:21:58 | 0 | 3 | 20 | A | Low | 0 | -- | 1007 | No |
| 166.129.148.150 | 1 | 5/11/1996 | 00:23:43 | 00:23:43 | 0 | 3 | 20 | B | Low | 0 | -- | 443 | No |
| 166.129.148.152 | 1 | 4/16/1996 | 05:44:18 | 05:44:18 | 0 | 3 | 20 | B | Low | 0 | -- | 673 | No |

| Address | Log # | Date | Start Time | End Time | Duration | Class | ID | Chan | Priority | G. Time | Final G. | Intensity | Preempt |
|---|---|---|---|---|---|---|---|---|---|---|---|---|---|
| 166.129.0.94 | 1 | 1/1/1995 | 13:48:42 | 13:48:42 | 0 | 5 | 10 | A | Low | 0 | -- | 1026 | No |
| 166.129.0.94 | 1 | 1/1/1995 | 14:16:14 | 14:16:30 | 16 | 5 | 10 | A | High | 0 | -- | 1018 | Yes |
| 166.129.0.94 | 1 | 1/1/1995 | 14:16:54 | 14:17:15 | 21 | 5 | 10 | A | Probe | 0 | -- | 1018 | No |

DEVICE AND METHOD FOR INTEGRATED WIRELESS TRANSIT AND EMERGENCY VEHICLE MANAGEMENT

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

BACKGROUND OF THE INVENTION

Field of the Invention

The present invention relates generally to integrated wireless transit and emergency vehicle management systems. In particular, the present invention is directed to extending the capability of existing and future traffic preemption technologies to include automatic vehicle location ("AVL"), vehicle detection, remote traffic signal preemption, and remote access to transit and emergency vehicle information by integrating existing and future traffic preemption systems with geographical information system(s) ("GIS"), mapping systems, central decision support system ("DSS") for transit, database and data-warehousing, internet or intranet based data-warehousing, wireless hand held personal computers/organizers, and wireless cellular digital packet data ("CDPD") through communication software protocol and application software interface ("API") and methods allowing remote communication for transfer of vehicle command, identification, and control data to and from a plurality of field intersections sites to and from a centralized location. The AVL system can detect the location of transit or emergency vehicles as they approach the intersection. The range of detection in one particular application is approximately 2500 feet. This AVL method is easily and simply provided, and functionally equals multi-million dollar satellite-based GPS systems. In an exemplary embodiment, the system of the present invention has the ability to transfer the preemption and probe for emergency vehicles and predetermined transit vehicles as data reports to end users for viewing and further analysis.

Description of the Related Art including Information Disclosed under 37 C.F.R. 1.97 and 1.98

A search of the prior art located the following United States patents which are believed to be representative of the present state of the prior art: U.S. Pat. No. 6,275,991 B1, issued Aug. 14, 2001, U.S. Pat. No. 5,955,968, issued Sep. 21, 1999, U.S. Pat. No. 5,959,551, issued Sep. 28, 1999, U.S. Pat. No. 5,977,883, issued Nov. 2, 1999.

BRIEF SUMMARY OF THE INVENTION

The primary traffic signal preemption system used today relies on optical emitter/receiver systems, such as the Opticom system marketed by 3M, or similar hardware. These systems typically provide two modes of operation, high priority and low priority. High priority is used for fire and emergency vehicles. High priority changes the red light to green and/or maintains green light for an extended period of time to allow sufficient time for the emergency vehicle to pass safely through the intersection. The low priority is used for transit vehicles, such as buses. Low priority extends the green light or reduces the time cycle for the red light; however, low priority does not change the red light to green immediately. In the low priority setting, there is a probe mode that only identifies the vehicle and does not effect the traffic controller in any manner.

These preemption systems consist generally of three components: (i) an emitter; (ii) a receiver; and (iii) a preemption card. The emitter generally resides onboard the vehicle and flashes in certain frequencies providing an optical or radio signal in three modes of high priority, low priority, and probe. The receiver resides on top of the intersection signal arms in the traffic intersection. The receiver receives the optical or radio signal transmitted by the emitter and the signal is transported by electrical wire to the traffic controller cabinet located at each intersection. The preemption card is located within the traffic controller cabinet and acts to change the traffic light and/or receive the probe signal.

Current traffic signal preemption data reside at the traffic intersection and are stored electronically on memory devices at each intersection. Presently, this information includes log number, date, start time, end time, duration, class, vehicle ID, channel, type of priority (low/high/probe), green time, final green, emitter's intensity and preempt or not preempt. An example of this information is set forth in FIG. 6.

As specifically shown in FIG. 6 the time and date element is a function of setting up each traffic controller intersection and or setting up the preemption card's time and date in the cabinet. Initialization can be obtained by use of a laptop computer to synchronize the time and date of the laptop with the preemption card. The time and date element is one of the most important elements of the preemption information. In case of transit, the location of the transit vehicle and its proximity to the intersection in reference to an accurate time and date are desired to insure the validity and accuracy of vehicle arrival prediction and vehicle location as the vehicle travels through different intersections, through multi-jurisdictions, and possibly through different preemption systems and traffic controller systems. In case of emergency vehicles all of the above is essential and, more importantly, in case of an accident at the intersection involving an emergency vehicle, the exact time and date is of outmost importance, as emergency vehicles change the traffic light to green in the desired direction of travel, and the traffic crossing the intersection could experience unexpected changes in the intersection control signals and become engaged in a serious traffic accident. If electrical power is lost to a traffic controller cabinet, the preemption cards revert back to the manufacturing date, for example Jan. 1, 1985. Also the time in these devices drift and due to multi-agency, multi-jurisdictional nature of the travel route, coordination of accurate timing among agencies has been almost impossible, or heretofore not even attempted. An embodiment of the present invention utilizes GPS time stamp on all data and detection along any route. The GPS time is provided in twenty-four hour, U.S. Military Standard Time which is extremely accurate and is a significant improvement in the system. The GPS time is part of the wireless modems utilized in an embodiment of the present invention, and the time is integrated into the data reporting and AVL.

To access this information, traffic control personnel need to physically access the traffic controller box, provide the necessary security and manual unlocking device to open the controller box, and retrieve the data through a serial connection and laptop computer. The information processed by the equipment at the intersection generally expires at the intersection soon after processing. Coordination of the intersection resident preemption data to centralized control centers has been attempted with little success. Collection of preemption data from intersection to intersection has been likewise unsuccessful, and proposed solutions are complex and costly.

It is therefore, an object of the present invention to provide economical access to and distribution of traffic preemption data from a series of linked intersections within a defined traffic control grid.

It is a further object of the present invention to provide real time vehicle tracking and location capabilities for emergency vehicles and transit vehicles within a defined traffic control grid.

It is a further object of the present invention to convert the format of traffic intersection data and to then transmit the converted traffic intersection data via wireless modem to traffic control centers.

It is yet another object of the present invention provide real time arrival and departure forecasting for transit patrons.

It is another object of the present invention to improve on safety and management efficiencies of state-of-the-art traffic preemption systems.

It is another object of the present invention to provide emergency vehicle location and identification information along a defined and predetermined traffic flow corridor.

It is another object of the present invention to provide transit vehicle location and identification information along a defined and predetermined traffic flow corridor.

It is yet another object of the present invention to provide real time wireless communication between traffic control centers and traffic intersections within a defined traffic grid.

It is a further object of the present invention to provide real time wireless communication between traffic control centers and selected emergency or transit vehicles within a defined traffic grid, so as to allow for automated intersection signal preemption consistent with the level of priority of each respective vehicle prior to arrival of the vehicle.

It is yet a further object of the present invention to use traffic intersection data within existing mapping and geographical informational systems ("GIS") software.

It is yet another object of the present invention to provide real time GPS time stamps on all transmitted data and vehicle detection through the AVL system.

It is yet another object of the present invention to provide central DSS for transit priority.

It is yet another object of the present invention to provide central DSS for emergency vehicles dispatch and control.

It is yet another object of the present invention to provide database and data-warehousing applications to manage and analyze collected data.

It is yet another object of the present invention to provide Internet or Intranet based data warehousing to manage and analyze data over the World Wide Web and/or agencies LAN.

It is yet another object of the present invention to provide data and control over the wireless hand held personal computers/organizers.

It is yet another object of the present invention to provide an event alarm, such as detection of a transit or emergency vehicle at an intersection by routing the alarm message to an E-mail address, pager, cellular phone or a hand held computer over the World Wide Web.

Other features, advantages, and objects of the present invention will become apparent with reference to the following description and accompanying drawings.

DETAILED DESCRIPTION OF THE INVENTION

Intersection Priority Control System

A dual priority, encoded signal phase selector is plugged into an input card slot on a standard traffic controller equipped with priority phase selection software. A typical traffic controller suitable for this embodiment of the present invention is the 3M® OPTICOM® Type 170 Priority Control System emitters and detectors. The phase selector can be either two- or four-channel, such as the 3M® Model 752 two-channel or the 3M® Model 754 four-channel.

Figure 1:
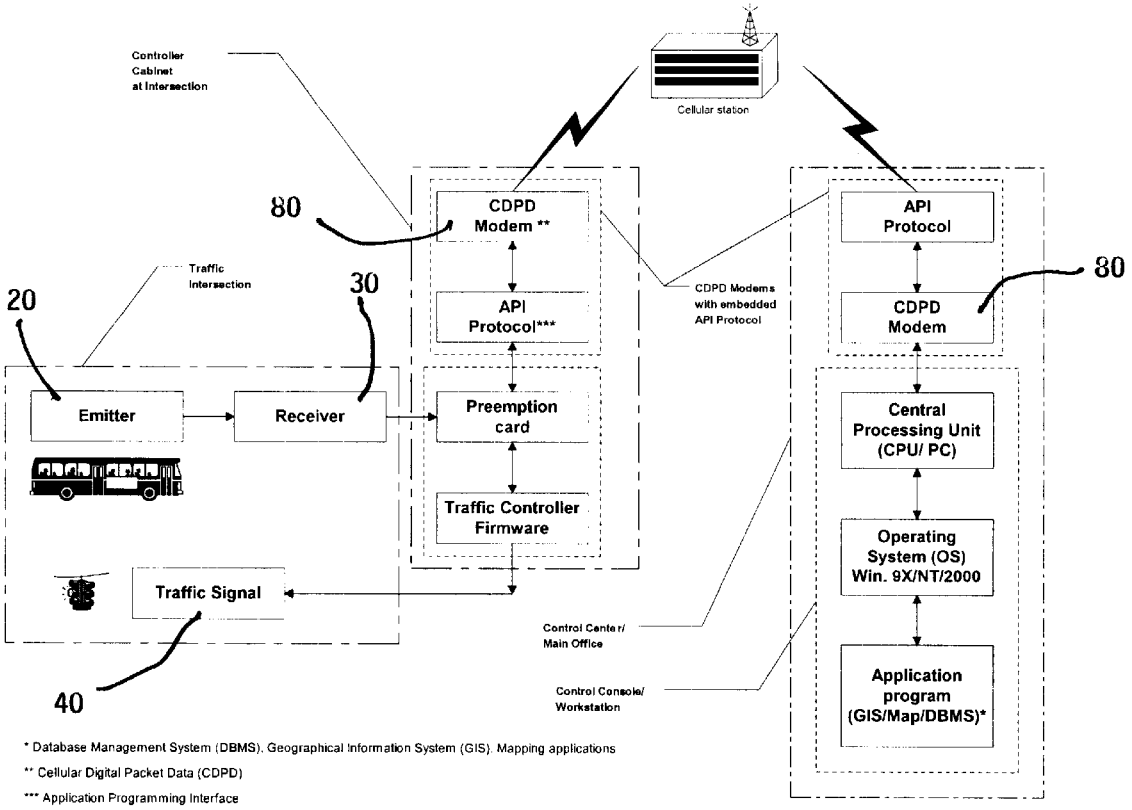
FIG. 1 is a block diagram of an embodiment of the present invention using cellular communications to transmit field data to the database management control center.
Figure 2:
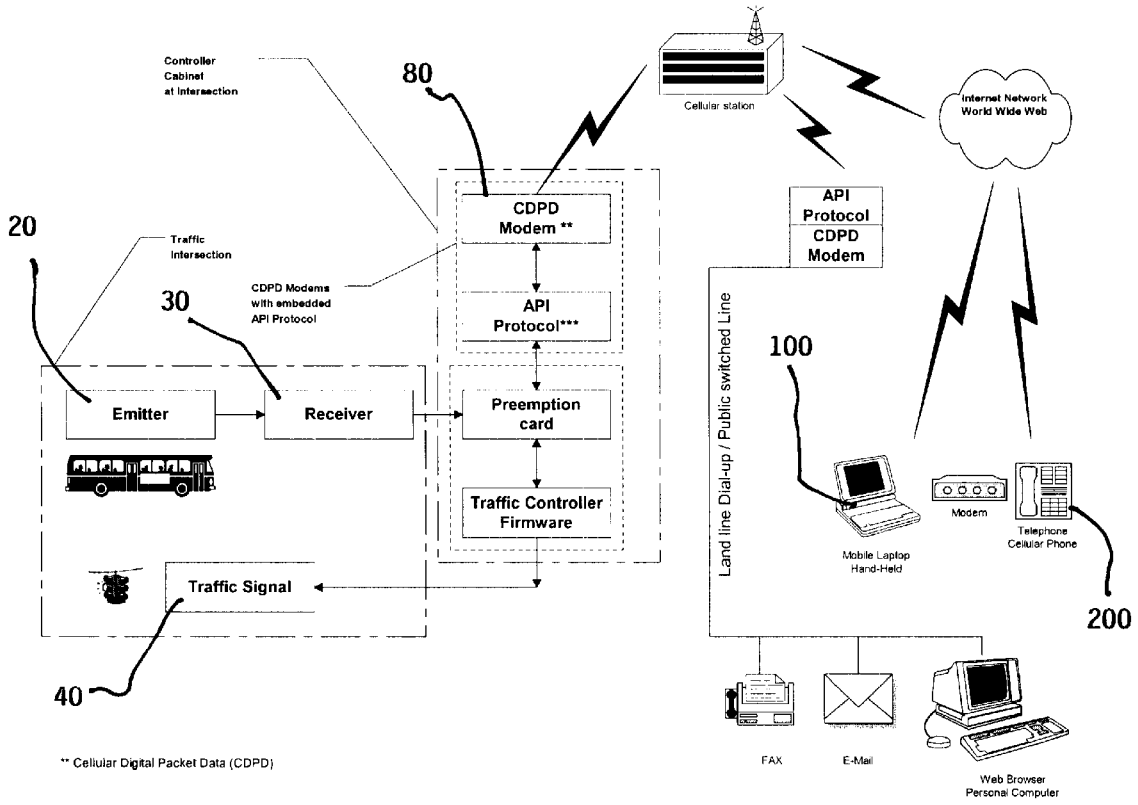
FIG. 2 is a block diagram of an embodiment of the present invention using the Internet and land lines to transmit field data to the database management control center.
Figure 3:
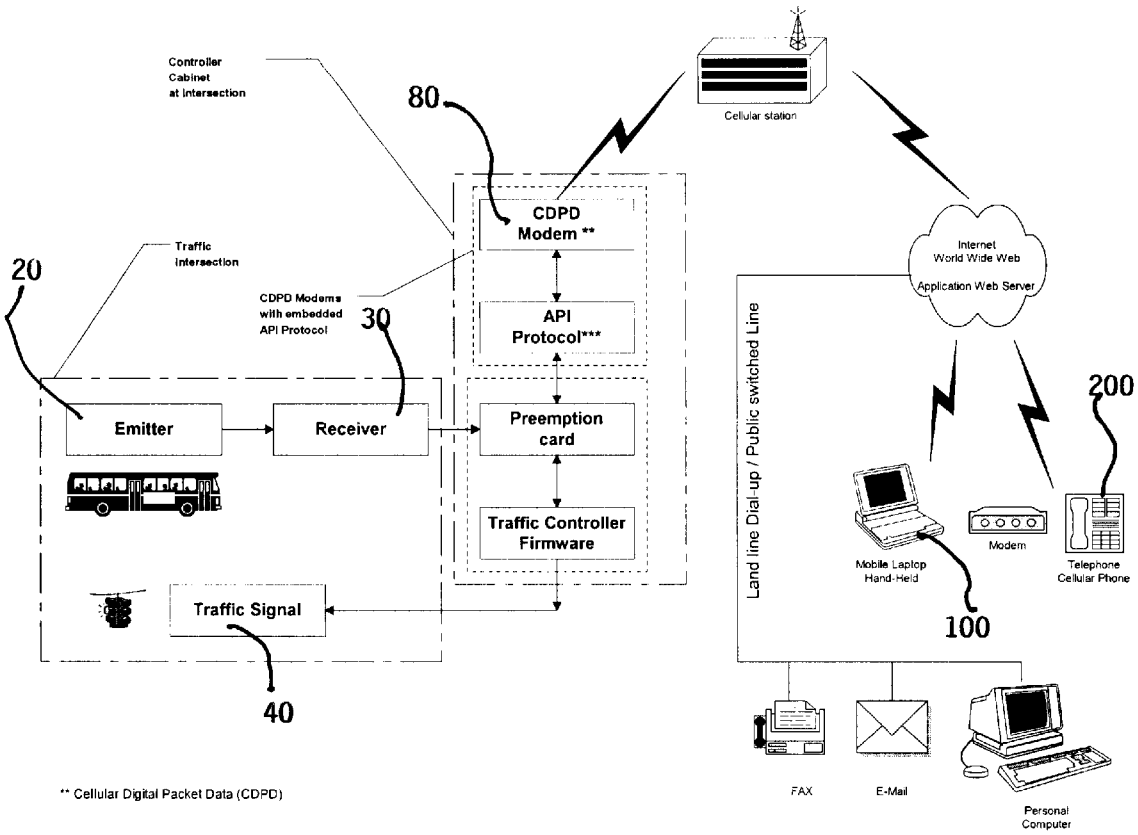
FIG. 3 is a block diagram of an embodiment of the present invention using the Internet and application software land lines to transmit field data to the database management control center.

As depicted in FIGS. 1, 2, and 3 the emitter 20 is a flashing, or strobe light mounted on a vehicle that broadcasts data and encoded infrared communications in a directional beam towards a detector or receiver 30 mounted on a post or traffic signal 40 cross-arm at an intersection. The detector or receiver 30 is a hooded service that receives and converts the infrared communications into electronic signals that are input to the phase selector.

The phase selector recognizes and discriminates among distinct emitter frequency rates as converted by the detector or receiver 30. For instance, for the OPTICOM® controller, there are three distinct frequency rates: command priority, advantage priority, and probe. The command priority is designated as high, while advantage is designated as low. The phase selector also recognizes and decodes up to 30,000 individual vehicle codes in the data communications exchange with the emitter 20.

Serial communications that output from the phase selector is a record of activation of the system. Each record contains:

1. Intersection Name;
2. Date and time of the activity;
3. Vehicle class code of the activating vehicle;
4. Activating vehicle's ID number;
5. Channel called;
6. Priority of the activity;
7. Final green signal indications displayed at the end of the call;
8. Time spent in the final greens;
9. Duration of the activation; and
10. Near intersection location information.

Serial communications output from the phase selector is a record of activation of the system. Each record contains: intersection name, date and time of the activity, vehicle class code of the activating vehicle, identification number or other mark of the activating vehicle, the channel called, the priority of the activity, final green signal indications displayed at the end of the call, the time spent in the final green activity, duration of the activation, and near intersection location information.

Cellular Digital Packet Data Modem

As shown in FIGS. 1, 2, and 3, full duplex cellular digital packet data ("CDPD") modems 80 provide wireless transport capabilities for fixed and mobile applications. A typical CDPD modem suitable for the present invention is the AirLink® Raven®.

CDPD is a technology used to transmit packet data over cellular voice networks. It is ideal for untethered applications. It is also more cost effective than circuit-switched cellular data for small amounts of data transmission. CDPD provides instantaneous response for transaction processing because there are no dialing delays. Built-in encryption maintains the security of the application data over the air.

CDPD protocols work over advanced mobile phone service ("AMPS"), the original analog cellular network or as a protocol for time division multiple access ("TDMA"), digital interface technology used in cellular and personal communications services. CDPD uses idle channels on the analog cellular system to transmit digital data. The 30 kHz channels used in AMPS can provide a data rate of 10.2 Kbits/sec., however, overhead reduces this to a more realistic rate of 9,600 bits/sec. The cellular telecommunications carrier has created a wireless information provider ("IP") network where each modem, like a cellular telephone with a 7–10 digit telephone number, has an IP address linked to the modem's equipment identification number ("EID"). The IP address is assigned a valid Internet address.

Among the many features, there are several that reflect directly upon the nature of the current evaluation using CDPD wireless modems.

1. Priority: The Opticom units under evaluation were signaled using LOW priority to avoid pre-empting the traffic signal at the intersection. PROBE priority was not used, since one of the three Opticom units did not respond to PROBE in either the "A" direction or the "B" direction.

2. Intensity: The signal intensity threshold of a phase selector may be adjusted by software via a personal computer or an encoded emitter. 200 feet to 2500 feet of operation may adjust activation based on signal intensity. For the purpose of this evaluation no changes in the operating parameters of the Opticom units were conducted. The units were evaluated in their "field operational state."

3. Processing time: The internal processing delay from detection to signal output is assessed by the manufacturer at 1.3 sec.

4. Record time: The time recorded for activation of the Opticom® units under evaluation was based on each unit's internal clock. No changes were made in the operating status of these units. Day, hour or minutes did not correlate between the phase selectors under evaluation.

As indicated in FIGS. 2 and 3, mobile users access the network via a laptop computer 100 or other computing devices 200 equipped with a wireless CDPD modem using AT commands to access the modem's embedded TCP/IP protocol stack to initiate a data communications link with another computing device. Remote devices, such as metering devices, can access server communication facilities and applications using TCP or UDP.

Data is transmitted via the modem along dedicated radio frequency channels. The data is received by a mobile data base station ("MDBS") that manages data transmission cellular channels. The MDBS delivers the data to a special-purpose intermediate communications system, which in turn routes data packets to the network backbone.

From the network backbone, the data is handed to routers in the network for delivery to the destination host system. The CDPD network is usually connected to the fixed end system through a frame relay network or the Internet. The wireless CDPD network provides a high level of security using encryption, client and host credential authorization and other transmission technologies known in the art. Customers can enhance their security requirements by addition of encryption, authorization, and firewall barriers peculiar to their respective needs.

Applications and special adaptations of CDPD modems have been very useful and enterprising. Location and tracking information can be reported by integrating global positioning system ("GPS") technology into the modem. Linked with a remote telemetry unit, wireless communications can provide access to and reporting of a myriad of control systems.

The Model 752 phase selector is a plug-in two-channel dual priority, encoded signal device designed for use with the 3M® Opticom® Priority Control System emitters and detectors. The Model 754 phase selector is a plug-in four channel, dual priority, encoded signal device with similar features of the Model 752. The Model 752 and 754 plug into an input card slot on the Type 170 traffic controller equipped with priority phase selection software. The Opticom® system has three components.

Evaluation

The evaluation was conducted from a vehicle equipped with an emitter, a CDPD radio and a personal computer displaying the received signal from an Opticom® phase selector installed at an intersection. The record of activation was hand logged from the PC display of the format set forth in FIG. 7.

Figure 7:
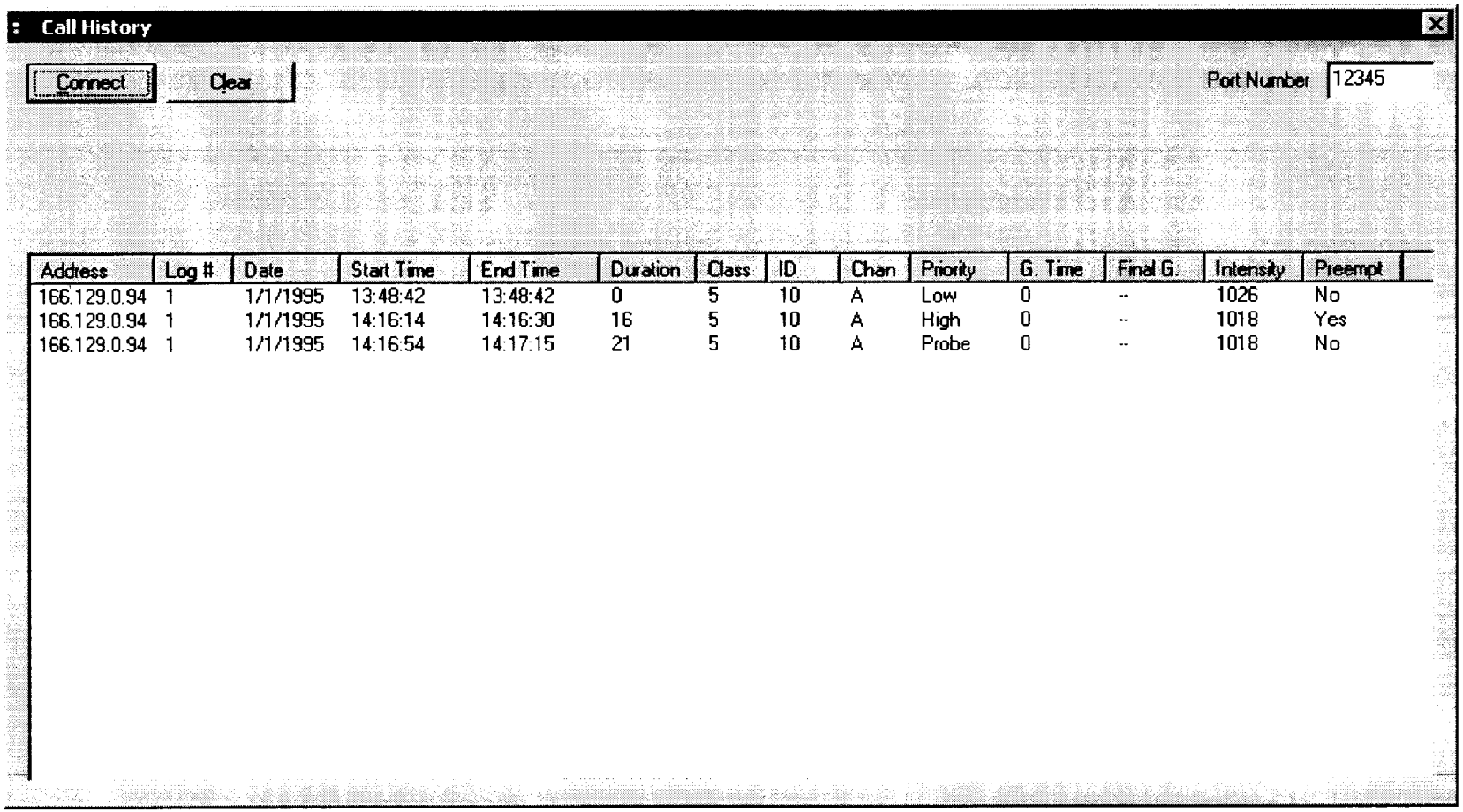
FIG. 7 is a tabular example of activation at a representative test intersection employing the present invention.

As shown in FIG. 7, the record "Call History" the column headings are:

1. Address: Internet Protocol "IP" address of the CDPD modem attached to the phase selector.
2. Log#: A function of the application "Call History."
3. Date/Time: As reported by the phase selector.
4. Duration: Duration of the activating signal from the emitter.
5. Class, ID and Chan: A function of the Opticom protocol. Note that channel "A" or "B" is a convention of the traffic management agency indicating direction of vehicle travel.

6. Priority: HIGH, LOW, PROBE
7. G. Time/Final G: A function of the phase selector.
8. Intensity: Signal Intensity measured by the phase selector.
9. Preempt: Record of preemption, Yes or No. In the example above, the measurement and priority were established on a test bench and not in an operating environment.

Figure 4:
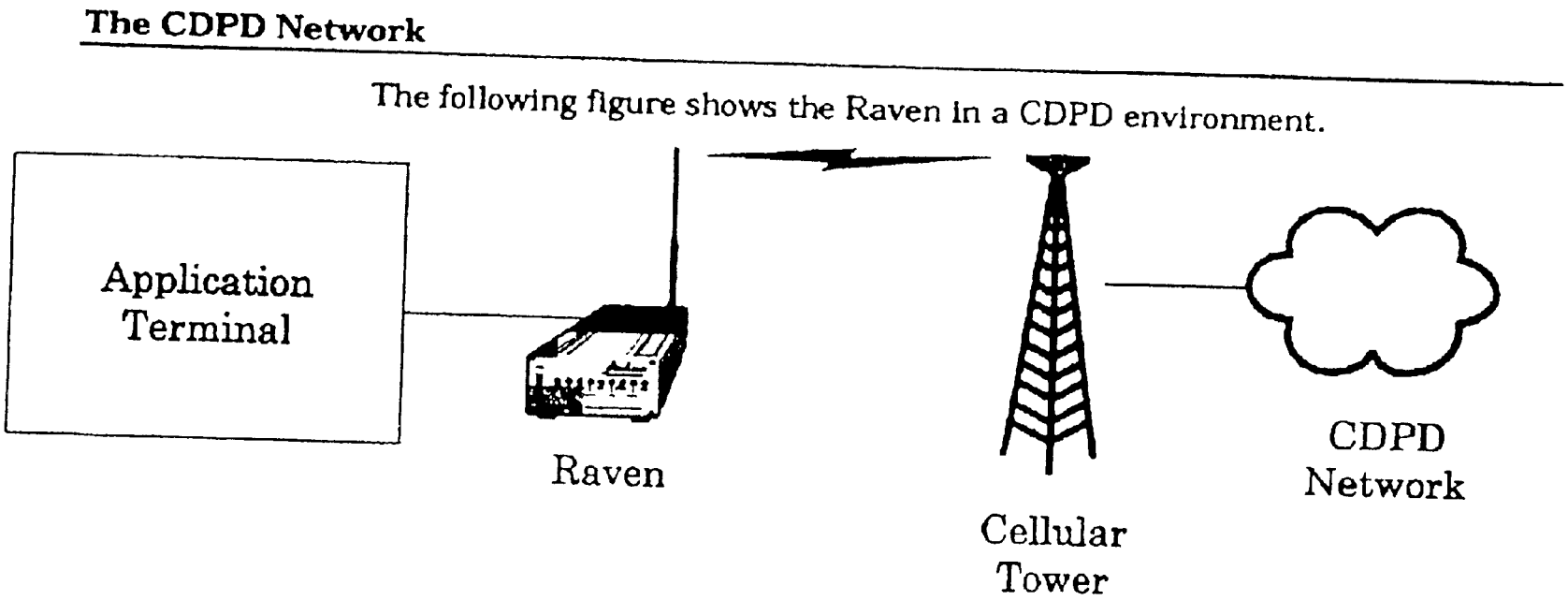
FIG. 4 is a diagram of a representative CDPD network for the present invention.

Performance Evaluation of a Wireless Communications and Reporting System Using CDPD How the AirLink® CDPD System Works The AirLink® Raven® CDPD modem is a full duplex Cellular Digital Packet Data (CDPD) modem that provides wireless transport capabilities for fixed and mobile applications. As depicted in FIG. 4, a CDPD Network 500 typically receives data from an application terminal 575 transmitted through a CDPD modem 550 to a cellular tower transmitter 525 and to the network 500. Although the AirLink® Raven® CDPD modem is shown in the test data and this figure, any commercial full duplex Cellular Digital Packet Data (CDPD) modem that provides wireless transport capabilities for fixed and mobile applications would suffice for the present invention.

CDPD is a technology used to transmit packet data over cellular voice networks. It is ideal for untethered applications. It is also more cost effective than circuit-switched cellular data for small amounts of data. It provides instantaneous response for transaction processing because there are no dialing delays. Built-in encryption maintains the security of the application data over the air.

CDPD is a digital packet data protocol designed to work over AMPS (Advanced Mobile Phone Service), the original analog cellular network or as a protocol for time division multiple access (TDMA), the digital air interface technology used in cellular and personal communications services. CDPD uses idle channels on the analog cellular system to transmit digital data. The 30 KHz channels used in AMPS can provide a data rate of 10.2 Kbits/sec, but overhead reduces this to a more realistic rate of 9,600 bits/sec. The cellular telecommunications carrier has created a wireless IP network where each modem, like a cellular telephone with a 7–10 digit telephone number, has an IP address linked to the modem's equipment identification number, or EID. The IP address is a valid Internet address.

Mobile users access the network via a laptop computer or other computing device equipped with a wireless CDPD modem using AT commands to access the modem's embedded TCP/IP protocol stack to initiate a data communications link with another computing device. Remote devices, such as metering devices can access server communications facilities and applications using TCP or UDP.

Data is transmitted via the modem along dedicated radio frequency channels. The data is received by a Mobile Data Base Station (MDBS) that manages data transmission cellular channels. The MDBS delivers the data to a special-purpose intermediate communications system, which in turn route data packets to the network backbone.

The data is then handed to routers in the network for delivery to the destination host system. The CDPD network is usually connected to the fixed end system through a frame relay network or the Internet. The wireless CDPD network provides a high level of security using AirLink® encryption, client and host credential authorization and other transmission technologies. However, customers can enhance their level of security by adding barriers of encryption, authorization and firewall.

Applications and special adaptations of the CDPD modems have proven very useful and enterprising. Location and tracking information can be reported by integrating Global Positioning System (GPS) technology into the modem. Linked with a remote telemetry unit, the wireless communications can provide access and reporting of oil and gas monitoring, public safety, automated signs, financial transactions and security systems.

Evaluation

Figure 5:
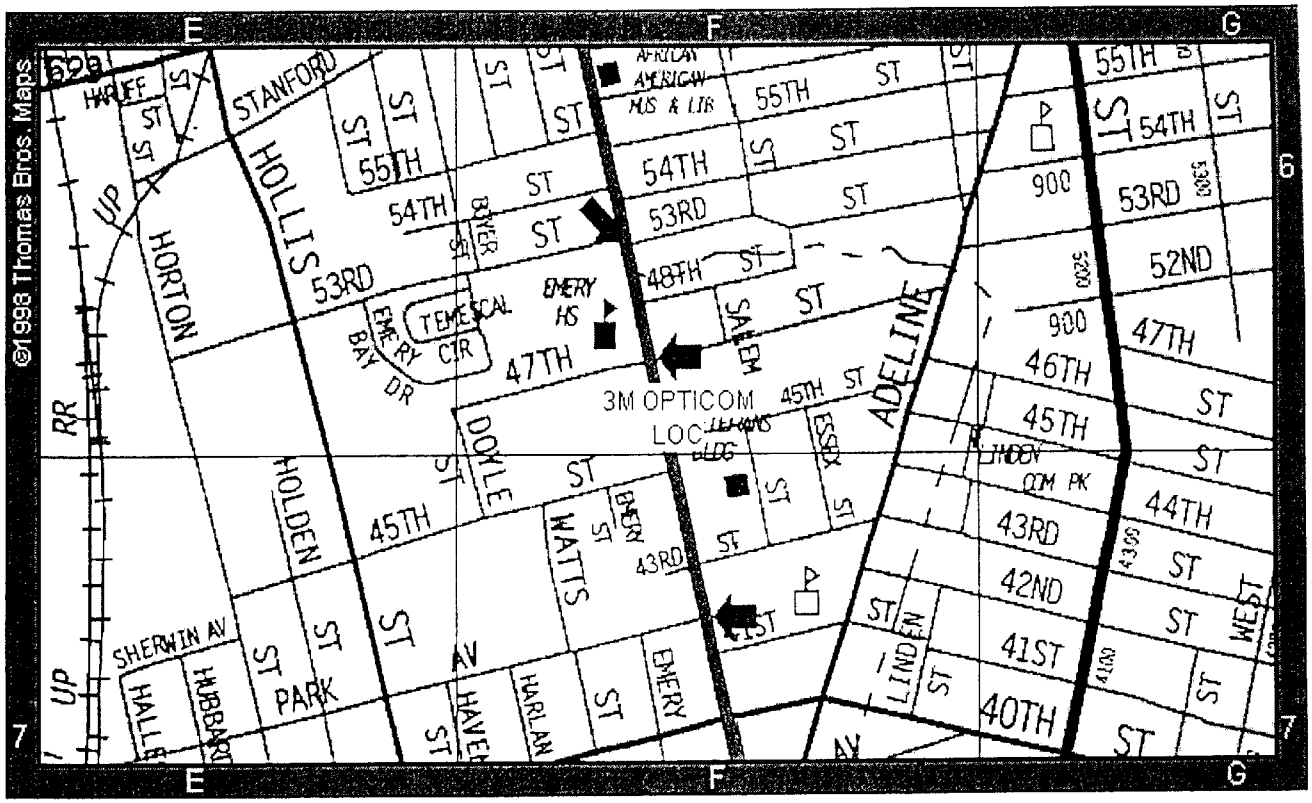
FIG. 5 is a map of the test installation locations for a test of the present invention detection capabilities.
Figure 5:
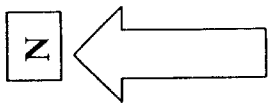
Figure 6:
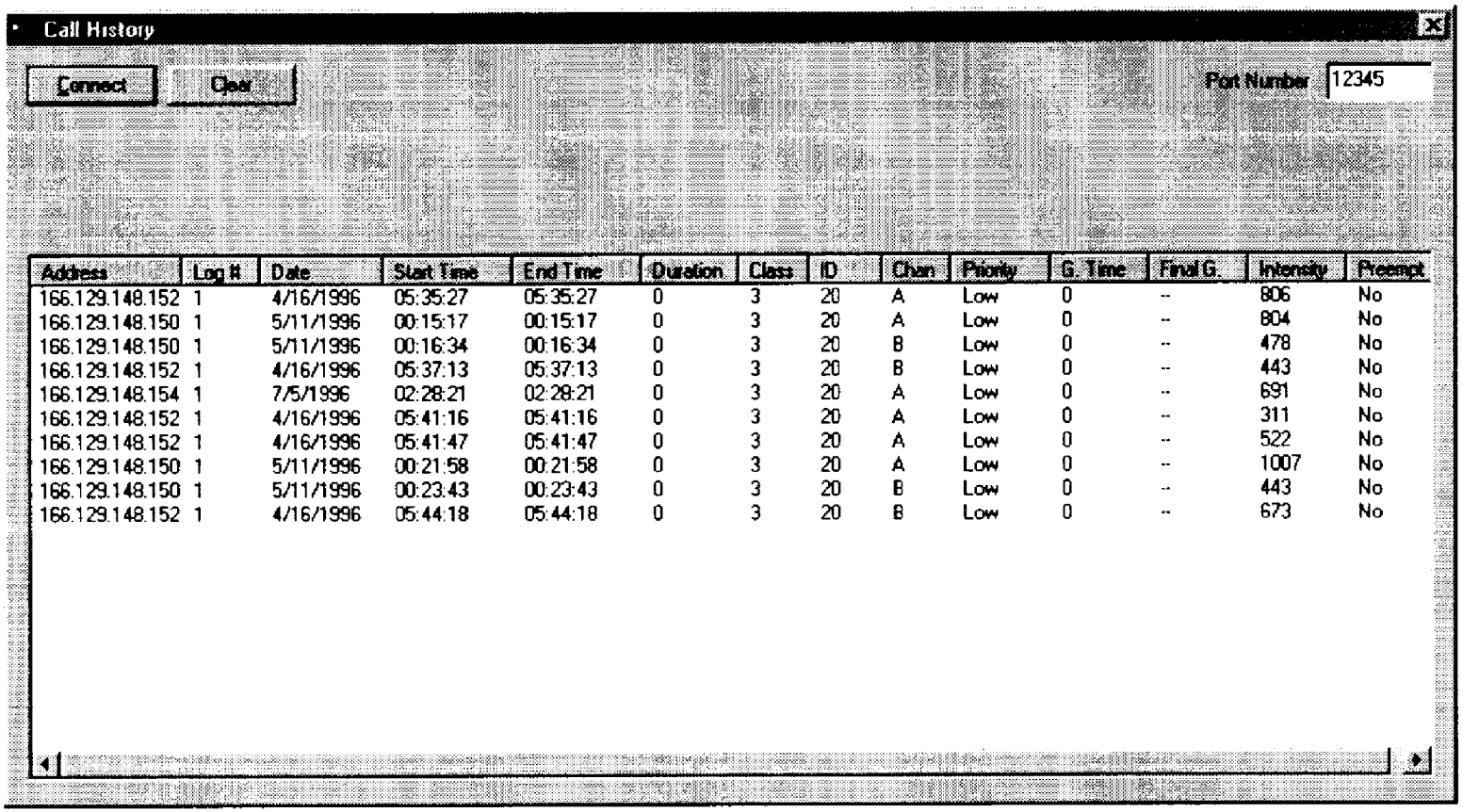
FIG. 6 is a tabular example of traffic signal preemption information.

The evaluation was conducted using CDPD modems as the wireless communications link. An Airlink® Raven® CDPD modem, antenna and serial communications cable was installed in each of three traffic control cabinets and attached to the Opticom®, Model 752 Phase Selector. As depicted in FIG. 5, the test installations were set up in a major traffic thoroughfare in Oakland, Calif.

Locations, or intersections adapted and evaluated were owned and managed by the California Department of Transportation. The Internet or IP address and street intersections are as follows:

IP address: 166.129.xxx.152

$47^{th}$ St & San Pablo Avenue

IP address: 166.129.xxx.150

$53^{rd\ St.}$ & San Pablo Avenue

IP address: 166.129.xxx.154

Park Avenue & San Pablo Avenue

The master modem which each of the above modems were linked was installed in a vehicle and attached to a notebook computer. The IP address of the master was 166.129.xxx.148. When the Opticom® Phase Selector was activated by a probe signal at any of the intersections, a report from the Phase Selector was transmitted and displayed on the computer screen in the vehicle.

In the evaluation of the present invention, test bench activation was exercised resulting in different ID codes on the screen. During the field evaluation, the data was recorded by hand since the application program "History" was still in the development process and the files presented could not be saved for recall.

The evaluation tests were conducted from a pre-measured route on San Pablo Avenue. A map of the test course is referenced in FIG. 5 to reference the test locations. Relevant distances recorded for recognizable monuments or markers for the distance measurement were taken in order to test and verify evaluation measurements. In this case, luminaire poles were used as prominent markers. The vehicle was moved in traffic and parked in the curb lane with the Opticom® emitter extended out an open window into the space of lane one, or curb lane to face the intersection under evaluation. The convenience of open parking spots, or clear areas to stop, determined the test measurement locations rather than pre arranged spots. In addition, the area near the intersections were often occupied by large vehicles such as delivery trucks and busses which blocked transmission line of site with the Opticom® detector mounted on the traffic signals cross-arm. The physical environment also prevented some of the tests, such as trees extending out over the traffic lanes.

At least three activations of the Opticom® Phase Selector were conducted from each stationary location. The emitter was allowed to strobe the target detector for 10 seconds. The accumulation of processing time of the Opticom® Phase Selector at 1.3 sec., 5.0 sec. delay of reporting of the "History" application program, 1.0 sec. of delay in the cellular transmission system and the latent delay in updating the computer screen for the new record resulted in a lag time of approximately 10 seconds in reporting the result from the Phase Selector. Confirmation of a "good" test was needed to verify that the test environment was satisfactory and that either another test would be initiated, or the test vehicle could be moved to a new location. A sample of the data recorded for the evaluation follows. The column headings are identified in the discussion of the Opticom® Priority Control System.

Starting at Adeline St. Facing North towards PARK Ave.

| IP | Location | Time | Duration | Priority | Distance/ft | Intensity | Channel |
|---|---|---|---|---|---|---|---|
| .154 | #5593 | 1:37 | 10 sec | LOW | 1028 | 431 | A |
| .154 | #5589 | 1:51 | 10 sec | LOW | 893 | 527 | A |
| .152 | #5589 | 1:51 | 10 sec | LOW | 2141 | 316 | A |
| .154 | #5583 | 1:54 | 10 sec | LOW | 717 | 533 | A |
| .152 | #5583 | 1:54 | 10 sec | LOW | 1955 | 326 | A |
| .154 | #19 | 1:58 | 10 sec | LOW | 433 | 640 | A |
| .152 | #19 | 1:58 | 10 sec | LOW | 1681 | 370 | A |
| .154 | #20 | 2:00 | 10 sec | LOW | 333 | 708 | A |
| .152 | #20 | 2:00 | 10 sec | LOW | 1581 | 379 | A |
| .154 | #5759 | 2:02 | 10 sec | LOW | 276 | 794 | A |
| .152 | #5759 | 2:02 | 10 sec | LOW | 1524 | 380 | A |
| .154 | #21 | 2:04 | 10 sec | LOW | 202 | 898 | A |
| .152 | #21 | 2:04 | 10 sec | LOW | 1450 | 396 | A |

Test results as recorded approaching Park Ave. & San Pablo Ave.

In this example, the tests started from a location South of Park Avenue and San Pablo Avenue. facing north traveling on San Pablo Avenue At first, the response was received only from Park Ave. Either because of line of sight clearance or the fact that the Opticom® Detector at $47^{th}$ Street was configured to receive from an emitter at distance of 2141 feet, both intersections reported as the vehicle was relocated closer to the detectors.

There was very close correlation between distance from the detector as shown on the graph of the same test sequence. A complete record of the testing follows in this application.

3M® Opticom® With Raven® Installed

Distance and Intensity of Signal

3M OPTICOM® tests, Jun. 8, 2001

Oakland

Calif.

Controller cabinets at three locations were furnished with Raven II CDPD modems attached to the OPTICOM® Service card. The OPTICOM® light sensor mounted on traffic signal cross-arms at these intersections was activated by a OPTICOM® probe manually operated in the test vehicle. An Intel PC executing an applications program and operating a Raven II CDPD modem linked to the intersection CDPD modems monitored the test, or illumination of each intersection from varying distances. The results of these tests are enumerated below.

The distance measurements were pre-surveyed by walk-out with a calibrated surveyor's wheel.

IP=Last three digits of IP address, used to identify the location

Location=Position of test vehicle parked at curb. Refer to sketch for reference.

Time=time of illumination for each test

Duration=duration of the test illumination

Priority=The OPTICOM® probe has three settings, PROBE, LOW and HIGH; only LOW was used in the tests Channel=Card Slot and assignment of the OPTICOM® used to identify direction of travel (activation)

Distance=feet from intersection traffic signal cross-arm that the test was conducted.

Intensity=Receive signal strength as measured by the OPTICOM® card at the intersection.

| | | |
|---|---|---|
| IP and Intersection | .152 | 47th St. & San Pablo Blvd. |
| | .150 | 53rd St. & San Pablo Blvd. |
| | .154 | Park Ave. & San Pablo Blvd. |

Starting at Adeline St. Facing East towards PARK Ave.

| IP | Location | Time | Duration | Priority | Distance/ft | Intensity | Channel |
|---|---|---|---|---|---|---|---|
| .154 | #5593 | 1:37 | 10 sec | LOW | 1028 | 431 | A |
| .154 | #5589 | 1:51 | 10 sec | LOW | 893 | 527 | A |
| .154 | #5583 | 1:54 | 10 sec | LOW | 717 | 533 | A |
| .154 | #19 | 1:58 | 10 sec | LOW | 433 | 640 | A |
| .154 | #20 | 2:00 | 10 sec | LOW | 333 | 708 | A |
| .154 | #5759 | 2:02 | 10 sec | LOW | 276 | 794 | A |
| .154 | #21 | 2:04 | 10 sec | LOW | 202 | 898 | A |

Concurrent reading

| IP | Location | Time | Duration | Priority | Distance/ft | Intensity | Channel |
|---|---|---|---|---|---|---|---|
| .152 | #5589 | 1:51 | 10 sec | LOW | 2141 | 316 | A |
| .152 | #5583 | 1:54 | 10 sec | LOW | 1955 | 326 | A |
| .152 | #19 | 1:58 | 10 sec | LOW | 1681 | 370 | A |
| .152 | #20 | 2:00 | 10 sec | LOW | 1581 | 379 | A |
| .152 | #5759 | 2:02 | 10 sec | LOW | 1524 | 380 | A |
| .152 | #21 | 2:04 | 10 sec | LOW | 1450 | 396 | A |
| .152 | #5761 | 2:08 | 10 sec | LOW | 1333 | 428 | A |
| .152 | #5765 | 2:09 | 10 sec | LOW | 705 | 514 | A |
| .152 | #5767 | 2:10 | 10 sec | LOW | 601 | 636 | A |
| .152 | #28 | 2:14 | 10 sec | LOW | 365 | 729 | A |
| .152 | #5769 | 2:15 | 10 sec | LOW | 237 | 808 | A |
| .152 | #5770 | 2:16 | 10 sec | LOW | 114 | 815 | A |

Concurrent reading

| IP | Location | Time | Duration | Priority | Distance/ft | Intensity | Channel |
|---|---|---|---|---|---|---|---|
| .150 | #5767 | 2:10 | 10 sec | LOW | 1151 | 238 | A |
| .150 | #28 | 2:14 | 10 sec | LOW | 869 | 386 | A |
| .150 | #5769 | 2:15 | 10 sec | LOW | 791 | 406 | A |
| .150 | #5770 | 2:16 | 10 sec | LOW | 664 | 422 | A |
| .150 | #32 | 2:32 | 10 sec | LOW | 486 | 587 | A |
| .150 | #33 | 2:36 | 10 sec | LOW | 382 | 675 | A |
| .150 | #34 | 2:38 | 10 sec | LOW | 279 | 814 | A |
| .150 | #35 | 2:40 | 10 sec | LOW | 169 | 905 | A |

Reversing direction at Stanford Ave.
St.
Facing West towards 53rd St.

| IP | Location | Time | Duration | Priority | Distance/ft | Intensity | Channel |
|---|---|---|---|---|---|---|---|
| .150 | A9764 | 2:43 | 10 sec | LOW | 1296 | 507 | B |
| .150 | A9762 | 2:49 | 10 sec | LOW | 1296 | 520 | B |
| .150 | A9756 | 2:50 | 10 sec | LOW | 822 | 603 | B |
| .150 | A9754 | 2:52 | 10 sec | LOW | 708 | 613 | B |
| .150 | 55th St. | 2:54 | 10 sec | LOW | 475 | 634 | B |
| .150 | A9748 | 2:58 | 10 sec | LOW | 424 | 644 | B |
| .150 | Tree, at 70' | 3:00 | 10 sec | LOW | 70 | 716 | B |

Concurrent
reading
Facing West towards 53rd St. and activating
47th St. also

| IP | Location | Time | Duration | Priority | Distance/ft | Intensity | Channel |
|---|---|---|---|---|---|---|---|
| .152 | A9762 | 2:49 | 10 sec | LOW | 1671 | 325 | B |
| .152 | A9756 | 2:50 | 10 sec | LOW | 1318 | 427 | B |
| .152 | A9754 | 2:52 | 10 sec | LOW | 1204 | 466 | B |
| .152 | 55th St. | 2:54 | 10 sec | LOW | 971 | 511 | B |
| .152 | A9748 | 2:58 | 10 sec | LOW | 920 | 523 | B |
| .152 | Tree, at 70' | 3:00 | 10 sec | LOW | 566 | 607 | B |
| .152 | Traffic Cab | 3:04 | 10 sec | LOW | 480 | 630 | B |
| .152 | Pole #1 | 3:09 | 10 sec | LOW | 381 | 632 | B |
| .152 | Pole #2 | 3:10 | 10 sec | LOW | 271 | 638 | B |
| .152 | Pole #3 | 3:11 | 10 sec | LOW | 168 | 699 | B |
| .152 | Pole #5 | 3:25 | 10 sec | LOW | 40 | 703 | B |

Testing was concluded at 3:30 after verifying that the Controller OPTICOM®
Card at PARK Ave. did not respond to the LOW or PROBE interrogations.

Figure 8:
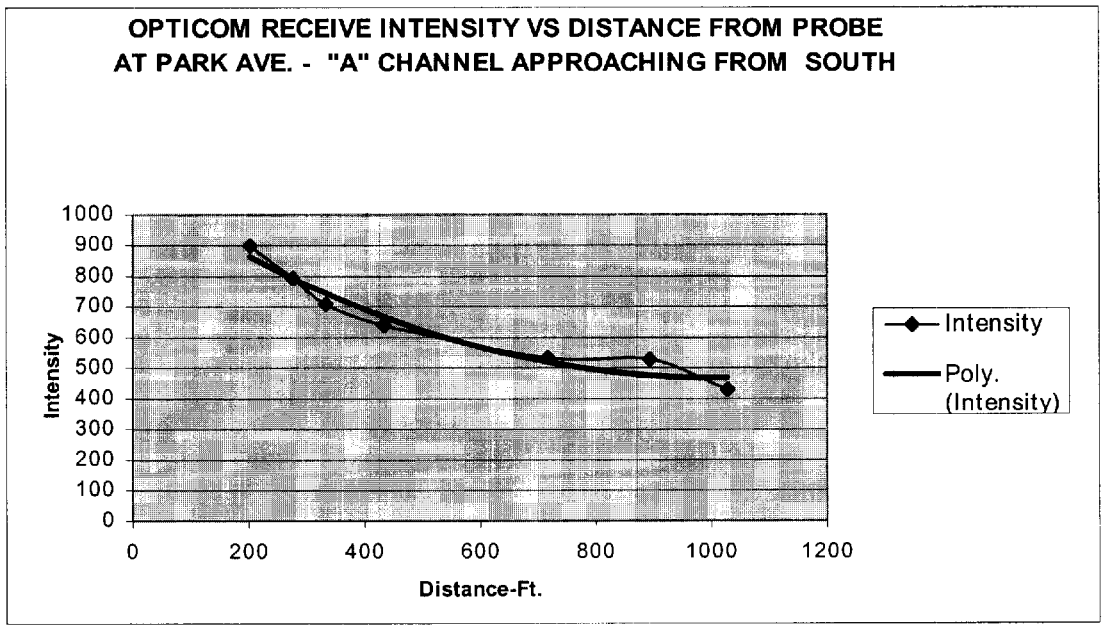
FIG. 8 is a graph of Opticom® receive intensity versus distance from the probe at the Park Avenue location with "A" channel approaching the intersection from the South.

The graph shown in FIG. 8, represents the Opticom® receive intensity versus distance from the probe at the Park Avenue location with "A" channel approaching the intersection from the South.

Figure 9:
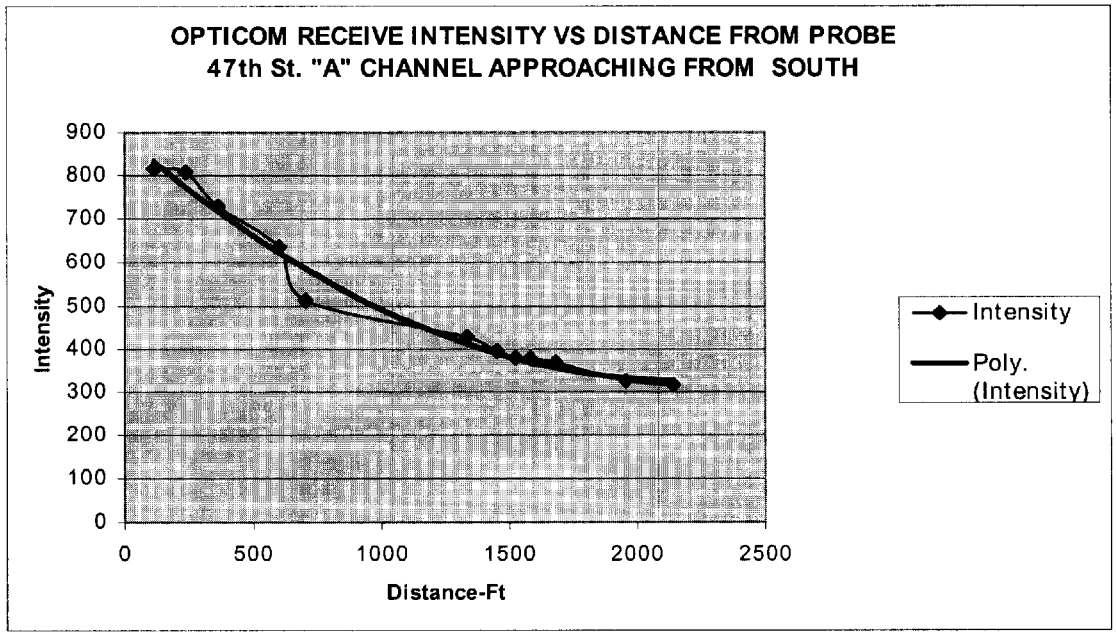
FIG. 9 is a graph Opticom® receive intensity versus distance from the probe at the 47TH Street location with "A" channel approaching the intersection from the South.

The graph shown in FIG. 9, represents the Opticom® receive intensity versus distance from the probe at the 47TH Street location with "A" channel approaching the intersection from the South.

Figure 10:
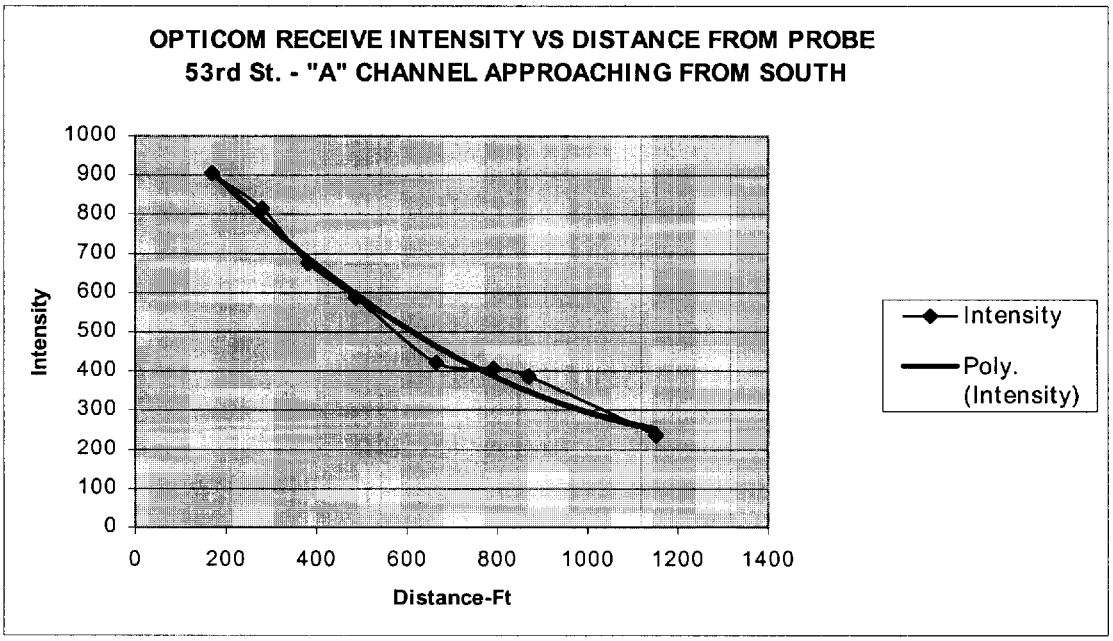
FIG. 10 is a graph of Opticom® receive intensity versus distance from the probe at the 53RD Street location with "A" channel approaching the intersection from the South.

The graph shown in FIG. 10, represents the Opticom® receive intensity versus distance from the probe at the 53RD Street location with "A" channel approaching the intersection from the South.

Figure 11:
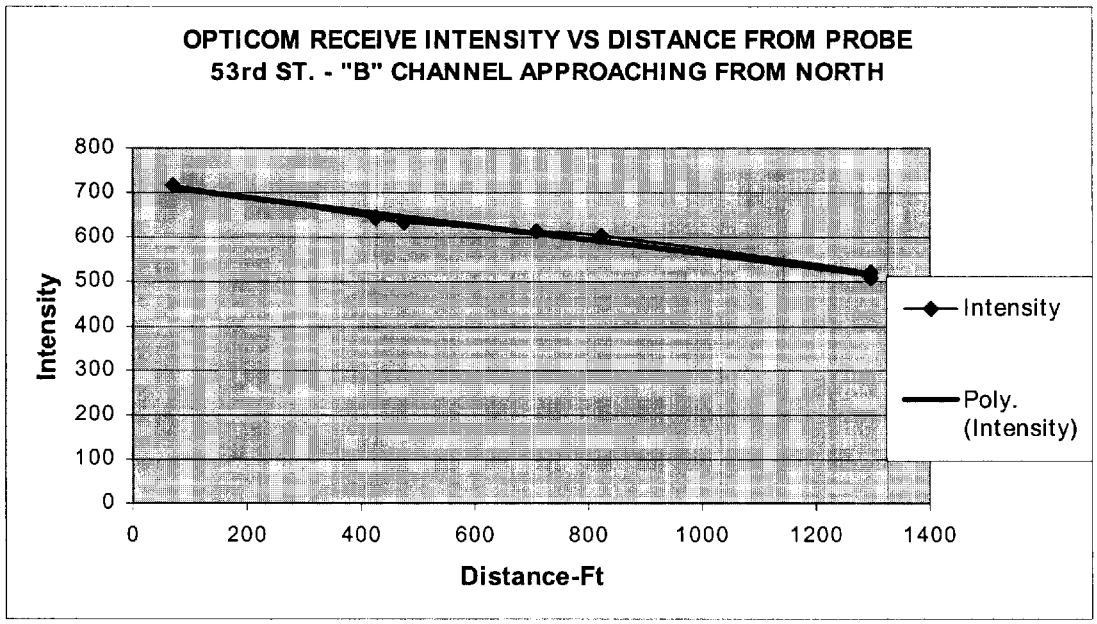
FIG. 11 is a graph of Opticom® receive intensity versus distance from the probe at the 53RD Street location with "B" channel approaching the intersection from the North.

The graph shown in FIG. 11, represents the Opticom® receive intensity versus distance from the probe at the 53RD Street location with "B" channel approaching the intersection from the North.

What is claimed is:

1. A device for integrated vehicle management comprising:

preemption means, further comprising at least one emitter, at least one detector, and at least one phase selector, wherein each phase selector recognizes and decodes up to 30,000 individual vehicle codes in data exchange with the emitter, and wherein each emitter further comprises a strobe light mounted on a vehicle that broadcasts data and encoded infrared communications in a directional beam towards the detector, and wherein each detector is a hooded device that receives and converts infrared signals from the emitter into electronic signals that are input to the phase selector, and wherein the electronic signals converted by the detector are command priority—high, advantage priority—low, and probe;

phase selector serial communications as a record of system activation and wherein each record further comprises, a. intersection identification,
b. date of the activity,
c. time of the activity,
d. vehicle class code of the activating vehicle,
e. channel called,
f. priority of the activity,
g. final green traffic intersection signal indications displayed at the end of the call,
h. time spent in the final green traffic intersection signal indication,
i. duration of the activation, and
j. near intersection location information;

application programming interface protocol;

communication means; and control center means.

2. The device according to claim 1 wherein the communications means further comprises a full duplex cellular digital packet data modem that provides wireless transport capabilities for fixed and mobile applications.

3. The device according to claim 2 wherein the modem further comprises an IP address linked to the modem equipment identification number and wherein the IP address further comprises a valid Internet address.

4. The device according to claim 3 wherein the communication means further comprises dedicated radio frequency channels and one or more mobile data base stations that manage(s) data transmission cellular channels and route digital data packets to the network backbone.

5. The device according to claim 4 wherein the digital data packets are secure.

6. The device according to claim 5 wherein the application programming interface protocol further comprises integrating global positioning system technology into the modem.

7. The device according to claim 6 wherein the control center means further comprises a central processing unit and operating system.

8. A device for integrated vehicle management comprising:

A. at least one preemption unit, each of which further comprises;

(i) at least one detector further comprising a hooded device that receives and converts infrared signals from an emitter into electronic signals that are input to a phase selector as either command priority—high, advantage priority—low, or probe, (ii) at least one emitter which further comprises a strobe light mounted on a vehicle that broadcasts data and encoded infrared communications in a directional beam towards the detector, and (iii) at least one phase selector which recognizes and decodes up to 30,000 individual vehicle codes in data exchange with the emitter and which provides serial communications as a record of system activation wherein each record further comprises:

a. intersection identification,
b. date of the activity,
c. time of the activity,
d. vehicle class code of the activating vehicle, e. channel called,
f. priority of the activity,
g. final green traffic intersection signal indications displayed at the end of the call,
h. time spent in the final green traffic intersection signal indication,
i. duration of the activation, and
j. near intersection location information;

B. at least one communications means which further comprises a full duplex cellular digital packet data modem that provides wireless transport capabilities for fixed and mobile applications and further comprising an IP address linked to the modem equipment identification number and wherein the IP address further comprises a valid Internet address;

C. application programming interface protocol which integrates each communications means with a system control center; and D. at least one system control center further comprising a central processing unit and operating system.

9. A method of using a device for integrated vehicle management comprising the steps:

A. defining a traffic control grid;

B. providing within the traffic control grid at least one preemption unit, each of which each further comprises;

(i) at least one detector further comprising a hooded device that receives and converts infrared signals from an emitter into electronic signals that are input to a phase selector as either command priority—high, advantage priority—low, or probe, (ii) at least one emitter which further comprises a strobe light mounted on a vehicle that broadcasts data and encoded infrared communications in a directional beam towards the detector, and (iii) at least one phase selector which recognizes and decodes up to 30,000 individual vehicle codes in data exchange with the emitter and which provides serial communications as a record of system activation wherein each record further comprises:

a. intersection identification,
b. date of the activity,
c. time of the activity,
d. vehicle class code of the activating vehicle,
e. channel called,
f. priority of the activity,
g. final green traffic intersection signal indications displayed at the end of the call,
h. time spent in the final green traffic intersection signal indication,
i. duration of the activation, and
j. near intersection location information;

C. providing for the traffic control grid at least one communications means which further comprises a full duplex cellular digital packet data modem that provides wireless transport capabilities for fixed and mobile applications and further comprising an IP address linked to the modem equipment identification number and wherein the IP address further comprises a valid Internet address;

D. providing application programming interface protocol which integrates each communications means with a system control center;

E. providing at least one system control center further comprising a central processing unit and operating system;

F. broadcasting data and encoded infrared communications from at least one vehicle emitter within the traffic control grid;

G. receiving and converting infrared signals from the emitter into electronic signals that are input to a phase selector as either command priority—high, advantage priority—low, or probe;

H. recognizing and decoding the electronic signals for up to 30,000 individual vehicle codes providing serial communications wherein each record further comprises;

1) intersection identification,
2) date of the activity,
3) time of the activity,
4) vehicle class code of the activating vehicle,
5) channel called,
6) priority of the activity,
7) final green traffic intersection signal indications displayed at the end of the call,
8) time spent in the final green traffic intersection signal indication,
9) duration of the activation, and
10) near intersection location information;

I. transmitting the serial communications to the control center;

J. analyzing the serial communications;

K. providing predetermined traffic control response to a traffic intersection control system within the traffic control grid; and L. providing predetermined traffic control reporting and management information systems within the traffic control grid.

10. An integrated vehicle management kit comprising:

A. at least one preemption unit, each of which further comprises;

(i) at least one detector further comprising a hooded device that receives and converts infrared signals from an emitter into electronic signals that are input to a phase selector as either command priority—high, advantage priority—low, or probe, (ii) at least one emitter which further comprises a strobe light mounted on a vehicle that broadcasts data and encoded infrared communications in a directional beam towards the detector, and (iii) at least one phase selector which recognizes and decodes up to 30,000 individual vehicle codes in data exchange with the emitter and which provides serial communications as a record of system activation wherein each record further comprises:

a. intersection identification,
b. date of the activity,
c. time of the activity,
d. vehicle class code of the activating vehicle,
e. channel called,
f. priority of the activity,
g. final green traffic intersection signal indications displayed at the end of the call,
h. time spent in the final green traffic intersection signal indication,
i. duration of the activation, and
j. near intersection location information;

B. at least one communications means which further comprises a full duplex cellular digital packet data modem that provides wireless transport capabilities for fixed and mobile applications and further comprising an IP address linked to the modem equipment identification number and wherein the IP address further comprises a valid Internet address;

C. application programming interface protocol which integrates each communications means with a system control center; and D. at least one system control center further comprising a central processing unit and operating system.

* * * * *